US011288905B2

(12) United States Patent
Dominici et al.

(10) Patent No.: US 11,288,905 B2
(45) Date of Patent: Mar. 29, 2022

(54) SYSTEM AND METHOD OF IDENTIFYING AND VERIFYING A VALID ENTRY OF AN APPLICATION USER INTO A VENUE USING CONTACTLESS CREDENTIAL VERIFICATION

(71) Applicants: Peter Dominici, Tampa, FL (US); John P. Dominici, Tampa, FL (US)

(72) Inventors: Peter Dominici, Tampa, FL (US); John P. Dominici, Tampa, FL (US)

( * ) Notice: Subject to any disclaimer, the term of this patent is extended or adjusted under 35 U.S.C. 154(b) by 0 days.

(21) Appl. No.: 17/303,823

(22) Filed: Jun. 8, 2021

(65) Prior Publication Data

US 2021/0383626 A1 Dec. 9, 2021

Related U.S. Application Data

(60) Provisional application No. 63/035,889, filed on Jun. 8, 2020.

(51) Int. Cl.

| | |
|---|---|
| ***G07C 9/00*** | (2020.01) |
| ***G07C 9/28*** | (2020.01) |
| ***G07C 9/27*** | (2020.01) |

(52) U.S. Cl.

CPC ..... *G07C 9/00817* (2013.01); *G07C 9/00309* (2013.01); *G07C 9/00904* (2013.01); *G07C 9/27* (2020.01); *G07C 9/28* (2020.01); *G07C 2009/00341* (2013.01); *G07C 2209/63* (2013.01)

(58) Field of Classification Search

CPC ..... G07C 9/00817; G07C 9/27; G07C 9/28; G07C 9/00309; G07C 9/00904

See application file for complete search history.

(56) References Cited

U.S. PATENT DOCUMENTS

| | | | | |
|---|---|---|---|---|
| 10,380,814 | B1 * | 8/2019 | Mathiesen | G07C 9/253 |
| 2011/0205022 | A1 * | 8/2011 | Cavallaro | G01S 17/18 340/8.1 |
| 2014/0139678 | A1 * | 5/2014 | Moriarty | G08B 13/19695 348/152 |
| 2017/0061715 | A1 * | 3/2017 | Busch-Sorensen | H04W 4/33 |
| 2017/0228949 | A1 * | 8/2017 | Trani | H04W 4/021 |
| 2019/0019361 | A1 * | 1/2019 | Kayhani | G06T 7/80 |
| 2020/0097732 | A1 * | 3/2020 | Doolittle | G06T 7/246 |

* cited by examiner

*Primary Examiner* — Nabil H Syed

(74) *Attorney, Agent, or Firm* — Smith & Hopen, P.A.; Paul Murty

(57) ABSTRACT

A comprehensive contactless entry verification system for use within a predefined space, such as an entry point to a venue requiring verified credentials for entry, including sporting events, modes of transportation, bars and restaurants, concerts, and other exclusive or limited capacity events. Rather than relying on a physical scanning event, the system improves an entry speed of a patron by automatically tracking, in real-time, a position of each patron within a predefined space, simultaneously querying, verifying, and tracking a credential associated with each patron for a contactless entry into a venue. Moreover, by allowing venue personnel to focus attention on security concerns rather than entry verification, the system improves safety protocols associated with a given event. The collaborative, comprehensive system includes cameras, transmitters, and a position engine, with each component working in combination to detect and verify a credential associated with one or more mobile devices.

10 Claims, 12 Drawing Sheets

Holding Grid

Funnel Grid

SYSTEM AND METHOD OF IDENTIFYING AND VERIFYING A VALID ENTRY OF AN APPLICATION USER INTO A VENUE USING CONTACTLESS CREDENTIAL VERIFICATION

CROSS-REFERENCE TO RELATED APPLICATIONS

This nonprovisional application is a continuation of and claims priority to provisional application No. 63/035,889, entitled "A method of identifying and verifying a person using geolocation and person recognition/a contact-less ticketing and payment system that is able to detect people who do not have a valid ticket or payment method stored on their mobile device," filed on Jun. 8, 2020, by the same inventors, the entirety of which is incorporated herein by reference.

BACKGROUND OF THE INVENTION

1. Field of the Invention

This invention relates, generally, to contactless entry systems for ticketed events and spaces. More specifically, it relates to systems for valid entry verification using one or more cameras and one or more antennas within a predefined space, designed to verify an agreement between an amount of people counted within the space through the cameras and the amount of credentials scanned from mobile devices associated with the people within the space.

2. Brief Description of the Prior Art

Traditionally, entry into a limited capacity event or space requires the possession of a physical or digital ticket. Prior to entering the event or space, a ticket holder must present the ticket, whether physical or digital, to an event management staff member. The staff member views and, in certain situations, scans the ticket to verify the validity of the ticket, as well as ensure that the ticket has not been previously scanned. Only upon a verification of both a valid ticket and a first-time entry does the ticket holder gain access to the space. Often, such a scanning event is associated with a unique code associated with the ticket, such as a barcode, a quick response code, or other scannable indicium that is unique to a singular ticket.

These traditional ticket verification systems function with relatively small failure rates, such that most, if not all, patrons within a location possess a valid ticket. However, such systems are time consuming by the nature of forcing a staff member to personally interact with each ticket holder entering a venue. For a relatively small-scale event with a few patrons, such personal interaction may only extend a line waiting time by a few minutes; however, for events such as sporting events including tens of thousands of patrons, ticket holders may be forced to wait in line for extended periods of time simply to verify that their ticket is valid.

Moreover, often, the process of entering a venue requires an additional step beyond ticket verification—safety verification. Particularly for larger events, security personnel must interact with patrons attempting to enter the venue to ensure that no patron enters the space with an unauthorized item, such as a weapon. These security stations are often located in close proximity to the ticket verification location; as such, waiting lines tend to condense into a confined space, within which multiple different tasks must be quickly performed to allow a patron to enter the venue, if authorized. As such, security personnel must maintain a watch over both the safety verification protocols, as well as the ticket verification location, ensuring not only that only authorized patrons enter a venue, but also that no unauthorized materials enter into the venue. Within the confined space proximate to a venue entrance, unauthorized patrons and/or materials can slip through security and ticketing verification, particularly for large-scale events.

Attempts have been made to provide remote-based security systems to enhance the ability of on-the-ground security personnel to concentrate on the more immediate dangers of unauthorized materials. For example, venues often employ camera technologies to record a given space, which can be monitored in real-time by a remote user, thereby helping the security personnel at the venue to identify all risks associated with the watched area. Moreover, venues have increasingly implemented scanner technologies that provide detailed images of patrons prior to entering a venue, as opposed to the more traditional metal detection screeners of the past. Each of these tools helps to ease security concerns within a venue; however, venues typically include a condensed space next to the entrance during which security and ticket verification must take place, even with these improved technologies. Moreover, while venues have increasingly implemented contactless scanning systems for tickets for both safety and health sanitization reasons, a physical or digital ticket often must be presented to gain entry into the venue.

Accordingly, what is needed is a comprehensive contactless entry verification system for use within a predefined space that eliminates the need for physical scanning events, thereby allowing venue staff to concentrate on security concerns, such as unauthorized materials, as opposed to credential verification. However, in view of the art considered as a whole at the time the present invention was made, it was not obvious to those of ordinary skill in the field of this invention how the shortcomings of the prior art could be overcome.

BRIEF SUMMARY OF THE INVENTION

The long-standing but heretofore unfulfilled need for a contactless credential verification system is now met by a new, useful, and nonobvious invention.

The novel system includes a predefined virtual grid displayed on a position engine executable on a computing device. The predefined virtual grid represents an enclosed space at an event venue that includes an initial threshold spaced apart from an entrance. A first plurality of cameras are disposed proximate to the initial threshold, such that the first plurality of cameras form a field of vision that includes the initial threshold. A second plurality of cameras disposed proximate to the entrance, such that the second plurality of cameras form a field of vision that includes the entrance, the second plurality of cameras in electronic communication with the position engine. The first plurality of cameras and the second plurality of cameras are in electronic communication with the position engine. The first plurality of cameras and the second plurality of cameras are configured to record and transmit at least one visual frame showing the enclosed space to the position engine.

A plurality of mobile devices are disposed within the enclosed space, with each of the plurality of mobile devices being associated with a patron of the event venue. At least one of the plurality of mobile devices includes a credential for attendance within the event venue. In an embodiment, the credential for attendance within the event venue is a unique combination of characters selected from the group consisting of numbers, letters, and symbols. In an embodiment, the computing device includes a database of credentials for attendance within the event venue generated to be associated with the plurality of patrons of the event venue, such that the computing device verifies an agreement between the received and the stored credentials.

A plurality of transmitters are disposed within the enclosed space. The plurality of transmitters are in electronic communication with the position engine, and are configured to be in electronic communication with the plurality of mobile devices. In an embodiment, the predefined virtual grid is partially defined by a coverage area associated with at least two of the plurality of transmitters, such that each portion of the predefined virtual grid is associated with a discrete point of the enclosed space that receives emitted signals from at least two of the plurality of transmitters.

The plurality of transmitters are configured to emit a signal readable by each of the plurality of mobile devices. The plurality of transmitters are also configured to receive the credential for attendance within the event venue from the at least one of the plurality of mobile devices, verify the credential for attendance, and transmit a confirmation of the verified credential to the position engine.

The position engine is configured to display, on the predefined virtual grid, a location of each of a plurality of patrons of the event venue based on the at least one visual frame showing the enclosed space received from the first plurality of cameras and the second plurality of cameras. In an embodiment, the position engine is configured to display a location of the verified credential. The position engine may place a bounding box over each of the plurality of patrons of the event venue, and display the bounding box on the predefined virtual grid. In an embodiment, the position engine displays a total number of the plurality of patrons of the event venue. The position engine compares the total number of the plurality of patrons of the event venue with the confirmation of the verified credential received from the plurality of transmitters to verify an agreement between the total number of the plurality of patrons of the event venue and the verified credential.

An embodiment of the system includes a second predefined virtual grid displayed on the position engine executable on the computing device. The second predefined virtual grid represents an enclosed space within the event venue, such that the entrance is disposed between the second predefined virtual grid and the threshold. A third plurality of cameras are disposed within the enclosed space within the event venue, and a second plurality of transmitters are disposed within the enclosed space within the event venue. The third plurality of cameras and the second plurality of transmitters are configured to transmit positional and credential data to the position engine for display on the second predefined virtual grid.

The novel method includes the step of disposing a plurality of transmitters within an enclosed space at an event venue. The enclosed space includes an initial threshold spaced apart from an entrance, such that the plurality of transmitters are disposed between the initial threshold spaced and the entrance. A first plurality of cameras are disposed proximate to the initial threshold, such that the first plurality of cameras form a field of vision that includes the initial threshold. A second plurality of cameras are disposed proximate to the entrance, such that the second plurality of cameras form a field of vision that includes the entrance.

The method includes the step of capturing, from each of the first plurality of cameras and the second plurality of cameras, an image of the enclosed space. The plurality of transmitters receive at least one unique credential for attendance within the event venue. A position engine executable on a computing device receives and displays the image of the enclosed space. In addition, the position engine receives the at least one unique credential for attendance. The position engine defines a virtual grid displayed thereon, which is defined by the initial threshold and the entrance. The method includes the step of counting, via the position engine, a total number of the plurality of venue patrons displayed in the image of the enclosed space. An embodiment of the method includes the step of placing, via the position engine, a bounding box over each of the plurality of venue patrons.

The position engine separates the at least one unique credential for attendance within the event venue into segments of the virtual grid. For each of the plurality of venue patrons, the position engine calculates a confidence rating representing a validity of the unique credential. The calculation is based on receiving multiple copies of the at least one unique credential for attendance within the event venue. Based on the confidence rating being above a minimum acceptable value for one of the plurality of venue patrons, the one of the plurality of venue patrons is allowed to traverse past the entrance. However, based on the confidence rating being below the minimum acceptable value for one of the plurality of venue patrons, the position engine transmits a security alert to a mobile device associated with a security personnel disposed within the enclosed space.

An embodiment of the method includes the step of verifying an agreement between the total number of the plurality of venue patrons and a total number of the at least one unique credential for attendance within the event venue. Based on the agreement between the total number of the plurality of venue patrons and a total number of the at least one unique credential for attendance within the event venue, each of the plurality of venue patrons traverse past the entrance. However, based on a disagreement between the total number of the plurality of venue patrons and a total number of the at least one unique credential for attendance within the event venue, the position engine transmits a security alert to a mobile device associated with a security personnel disposed within the enclosed space.

In an embodiment, the virtual grid is be defined by a coverage area associated with at least two of the plurality of transmitters, such that each portion of the virtual grid is associated with a discrete point of the enclosed space that receives emitted signals from at least two of the plurality of transmitters. In an embodiment, the virtual grid is segmented into a plurality of predefined segments having equal area.

In an embodiment, the at least one unique credential for attendance within the event venue is a unique combination of characters selected from the group consisting of numbers, letters, and symbols. The method further includes the steps of storing, on a database of the computer device, a plurality of unique credentials for attendance within the event venue, and comparing, via the position engine, the received at least one unique credential for attendance within the event venue with the database including the plurality of unique credentials for attendance within the event venue.

In an embodiment, the plurality of transmitters emit a plurality of signals that are receivable by one or more mobile devices disposed within the enclosed space. Each of the one or more mobile devices is associated with one of the plurality of venue patrons, and is selected from the group consisting of a smartphone, a tablet, and a laptop. The one or more mobile devices transmit the at least one unique credential for attendance within the event venue that is receivable by the plurality of transmitters. An embodiment of the method includes the step of calculating, via the position engine, a confidence rating representing a validity of the at least one unique credential for attendance within the event venue based on receiving multiple copies of the at least one unique credential for attendance within the event venue from the one or more mobile devices.

An object of the invention is to provide a contactless credential verification system that is used within a given space to count the amount of people within the space, and verify the counted amount with a detected amount of proper credentials, thereby allowing venue personnel to concentrate on security concerns, as opposed to entry verification.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

For a fuller understanding of the invention, reference should be made to the following detailed description, taken in connection with the accompanying drawings, in which.

DETAILED DESCRIPTION OF THE INVENTION

Figure 1:
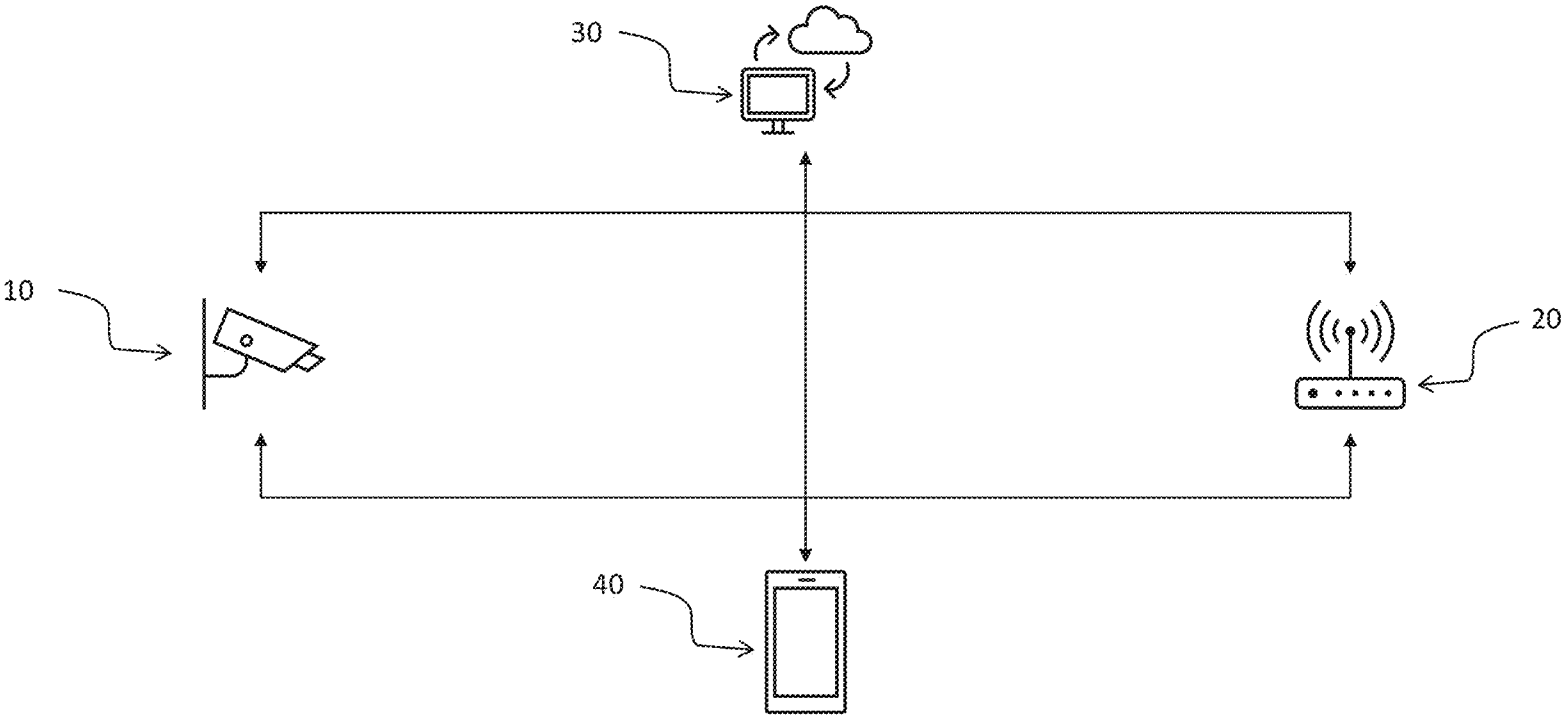
FIG. 1 is a process flow diagram depicting an architecture of a credential verification system, including one or more cameras, one or more transmitters, and a position engine working in combination to verify a credential associated with one or more mobile devices, in accordance with an embodiment of the present invention.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

All numerical designations are approximations which are varied up or down by increments of 1.0 or 0.1, as appropriate. It is to be understood, even if it is not always explicitly stated that all numerical designations are preceded by the term "about." As used herein, "about" or "approximately" refers to being within an acceptable error range for the particular value as determined by one of ordinary skill in the art, which will depend in part on how the value is measured or determined. As used herein, the term "about" refers to ±10% of the numerical; it should be understood that a numerical including an associated range with a lower boundary of greater than zero must be a non-zero numerical, and the term "about" should be understood to include only non-zero values in such scenarios.

As used herein, "camera" includes, but is not limited to, any device that is capable of recording and transmitting audio and/or visual data in the form of one or more frames within a field of vision, such as an infrared device, an infrared sensor, a motion sensor, a laser, a radar, a similar device, and combinations thereof.

As used herein, "transmitter" includes, but is not limited to, real-time location-based tracking devices that are capable of transmitting, receiving, and/or reflecting wave-based data emitted from an electronic device, such as radio-frequency identification (RFID), wireless network protocol-based radio waves (such as those provided under the trade name WI-FI™), wireless personal area networks (such as those provided under the trade name BLUETOOTH LOW ENERGY™), ultra-wideband signals, similar signals, and combinations thereof.

As used herein, "computing device" includes, but is not limited to, electronic devices that are capable or wired or wireless data transmission and that are capable of graphically displaying data to a viewing user, such as a personal computer, laptop, mobile device, or similar device.

As used herein, "mobile device" includes, but is not limited to, an electronic device that is capable of being carried by a user and is capable of data transmission without requiring a tethered power source, such as a smartphone, a tablet, a laptop, a wearable device such as a smart watch or smart glasses, an artificial and/or virtual reality device, or a similar device.

As used herein, "venue" includes, but is not limited to, an enclosed space, whether entirely enclosed by walls and/or a ceiling, partially enclosed by walls and/or a ceiling, or enclosed by outer boundaries but otherwise open to the ambient environment, within which is ticketed or otherwise limited event takes place, such as a sporting event, a concert, a restaurant, a bar, a theatre, an office building or other workplace requiring identification badges, a grocery store or other service providing establishment, a theme park, an airplane or other mode of transportation, or a similar location that provides a limit on an amount of individual within the space at a given time, thereby requiring the counting and/or verification of a presence of an individual in real-time.

The present invention includes a comprehensive contactless entry verification system for use within a predefined space, such as an entry point to a venue requiring verified credentials for entry, including sporting events, modes of transportation, bars and restaurants, concerts, and other exclusive or limited capacity events. Rather than relying on a physical scanning event, the present invention improves an entry speed of a patron by automatically tracking, in real-time, a position of each patron within a predefined space, simultaneously querying, verifying, and tracking a credential associated with each patron for a contactless entry into a venue. Moreover, by allowing venue personnel to focus attention on security concerns rather than entry verification, the present invention improves safety protocols associated with a given event. The present invention accomplishes these goals by providing a collaborative, comprehensive system including cameras, transmitters, and a position engine, with each component working in combination to detect and verify a credential associated with one or more mobile devices. The system will be described in greater detail in the sections herein below.

As shown in FIG. 1, an embodiment of the system includes an overall architecture including one or more cameras 10, one or more transmitters 20, and a position engine disposed on a computing device 30. Each of the cameras 10, transmitters 20, and position engine work in combination with each other to provide for bidirectional data transmission to and from each component; for example, data, such as audio and visual data, captured the cameras 10 can be transmitted to the computing device 30 and is readable by the position engine. Similarly, data from the transmitters 20, such as RFID data scanned by an antenna, can be transmitted to the computing device 30 and is readable by the position engine. Each of the cameras 10 and transmitters 20 is designed such that the data captured by each component is associated with one or more mobile devices 40 associated with patrons that are located within a capture radius of each of the cameras 10 and transmitters 20.

Figure 2:
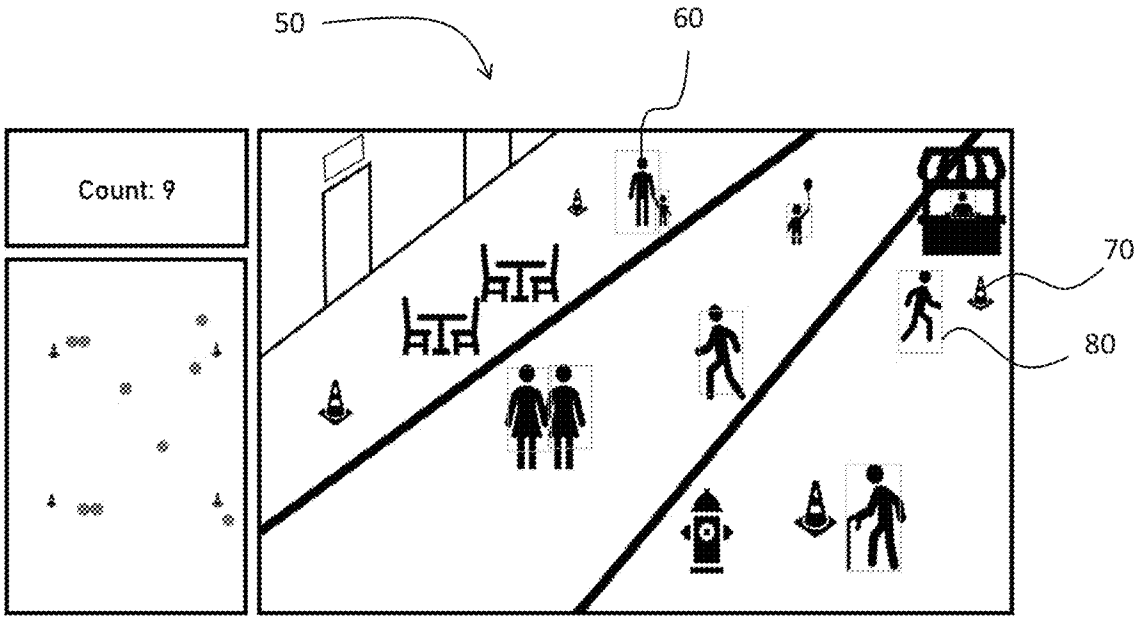
FIG. 2 is a depiction of a graphical user interface associated with the position engine of FIG. 1, showing a plurality of bounding boxes placed around identified individuals within a field of vision associated with a given camera, in accordance with an embodiment of the present invention.

Referring now to FIG. 2, an embodiment of the system provides a graphical depiction 50 of a field of vision on the computing device 30 via the position engine executable on the computing device 30. Each of the cameras 10 of the credential verification system captures and transmits at least visual data captured within the field of vision thereof, transmitting the data to the computing device 30 for display. Utilizing back-end classification protocols, such as conventional neural networks or similar classification systems, the position engine determines a likelihood that each object (such as human 60 or cone 70) captured within the field of vision is a human and places a bounding box 80 around each object classified as a person.

The position engine then graphically displays the objects in a simplified image, such that the persons detected in the image are assigned a different icon than non-persons within the image, thereby allowing a viewing user to quickly and easily identify humans within a given video frame. Moreover, the position engine thereby is capable of counting a total number of persons within the given video frame, and of tracking the total number of persons across subsequent video frames. The data received by the computing device 30 and displayed within the position engine are stored within a back-end database that is accessible by a back-end user, such as a security personnel or a network administrator.

Figure 3A:
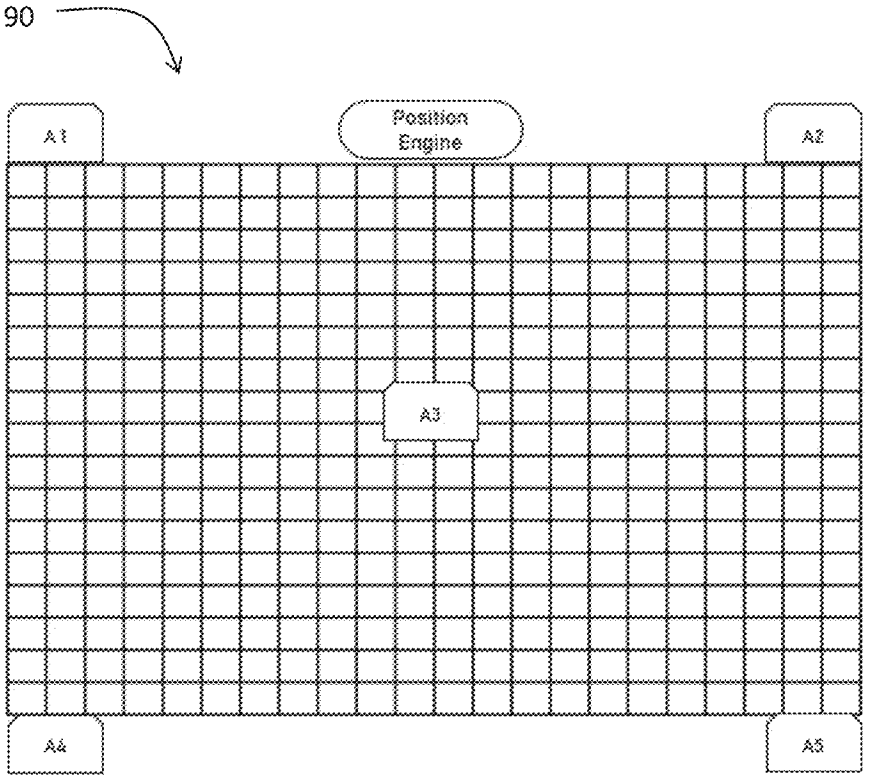
FIG. 3A is an orthogonal view of an initial positional grid associated with a given predefined space within which the credential verification system of FIG. 1 is implemented, in accordance with an embodiment of the present invention.
Figure 3B:
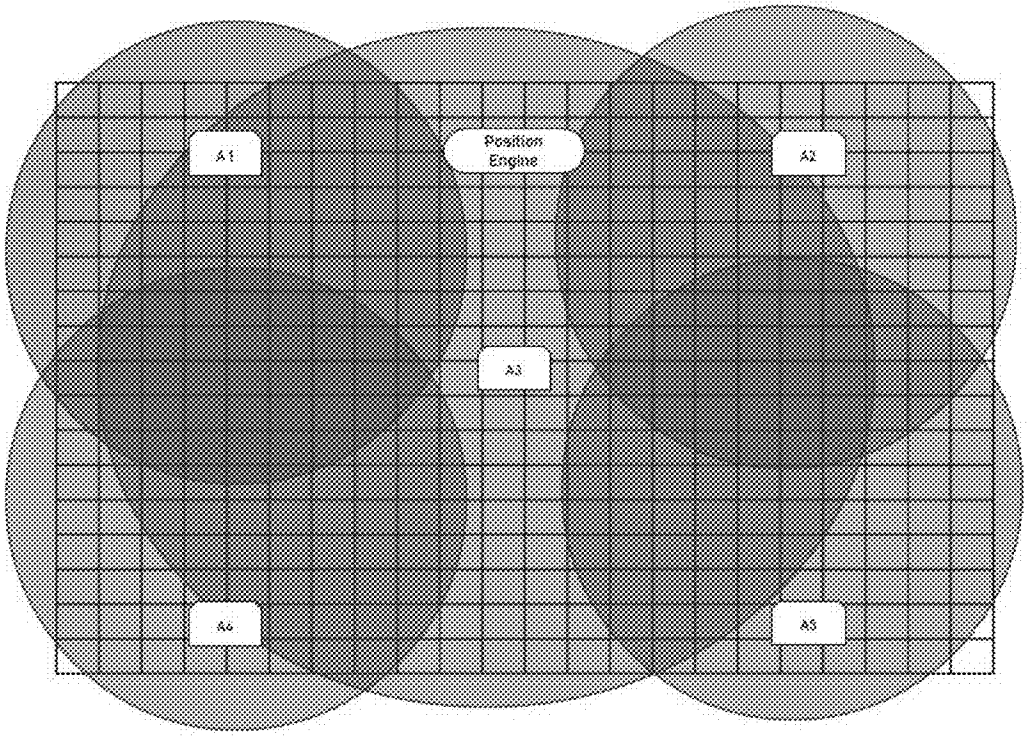
FIG. 3B is an orthogonal view of the grid of FIG. 3A, including a plurality of transmitters disposed about the predefined space, depicting a field of vision associated with each of the plurality of cameras, in accordance with an embodiment of the present invention.
Figure 3C:
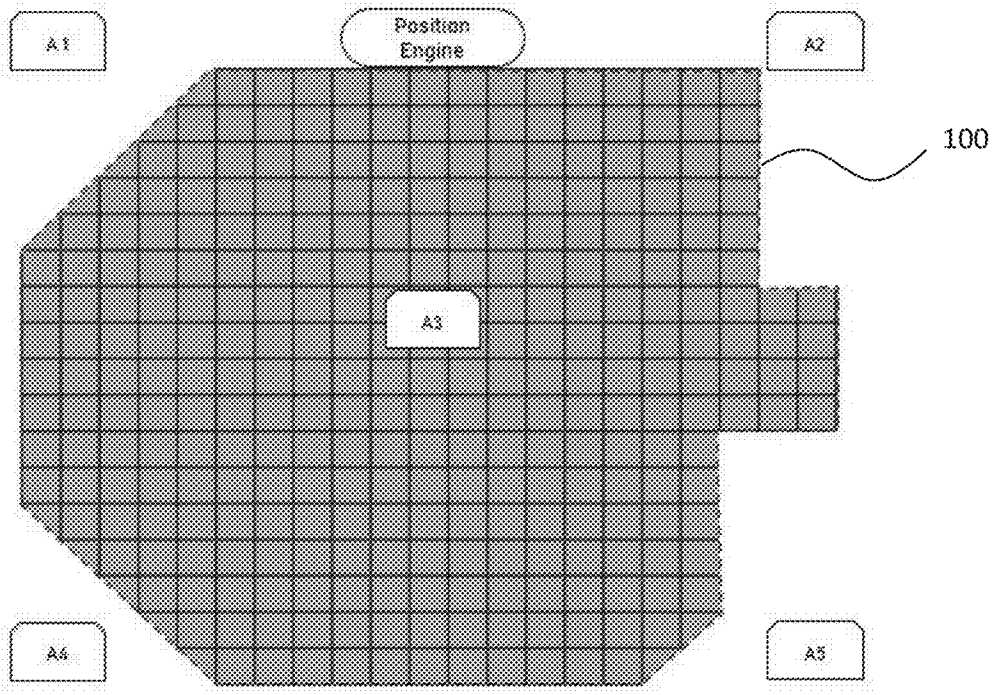
FIG. 3C is an orthogonal view of an embodiment of the grid of FIG. 3A, depicting a predefined space of the grid based on a position of each of the plurality of cameras of FIG. 3B and a desired recording angle of the cameras, in accordance with an embodiment of the present invention.

As shown in FIGS. 3A-3C, the system includes a grid-determination component allowing for the scalability of the system to venues of varying sizes, depending on the requirements of the end-user. In particular, FIG. 3A depicts an initial grid 90 for a given space, with the grid being initially defined by a position of a plurality of transmitters (A1, A2, A3, A4, and A5), such as antennas, within the space. However, as shown in FIG. 3B, transmitters typically function in more than one direction, providing for coverage in angles up to 360°. As such, an initial grid as shown in the embodiment of FIG. 3A may include areas that are not of interest to the system, such as areas that are enclosed within a set of walls that are out of range of the area of interest—in this case, an entry point to a venue or other event.

Moreover, as shown in FIG. 3B, depending on an arrangement of the transmitters, portions of the space may be covered by one transmitter 20, or may be covered by more than one transmitter 20. Since signal detection is stronger based on a proximity of a signal emission device and a transmitter 20, the system accomplishes increased confidence in situation in which multiple transmitters 20 capture signals related to a single device. As such, areas in which only one transmitter 20 provides coverage may receive incomplete data that is discountable by the system due to a low associated confidence level. Accordingly, as shown in FIG. 3C, a predefined grid 100 is determined based on a location of each of the plurality of transmitters 20, as well as a coverage area for each transmitter 20; the grid 100 is preferably determined based on an enhanced confidence level associated with transmitter overlap, such that multiple transmitters 20 capture signals across the regardless of a location of a mobile device therein. Moreover, as will be described in greater detail below, the predefined grid 100 is used to separate patrons into different locations on the grid to determine a confidence level associated with a valid credential of a patron or a group of patrons based on a proximity of the patron to one or more valid credentials.

Figure 4B:
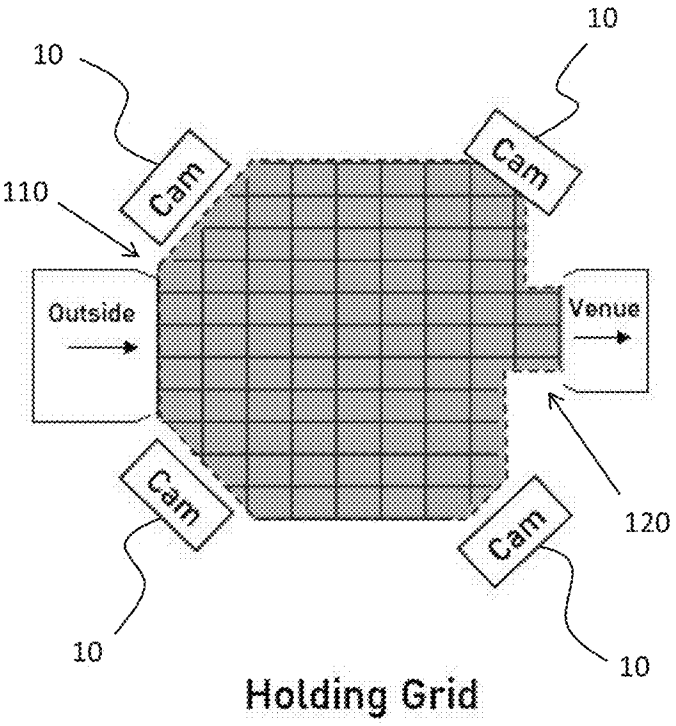
FIG. 4B is an orthogonal view of a holding grid associated with a given predefined space within which the credential verification system of FIG. 1 is implemented, in accordance with an embodiment of the present invention.
Figure 4A:
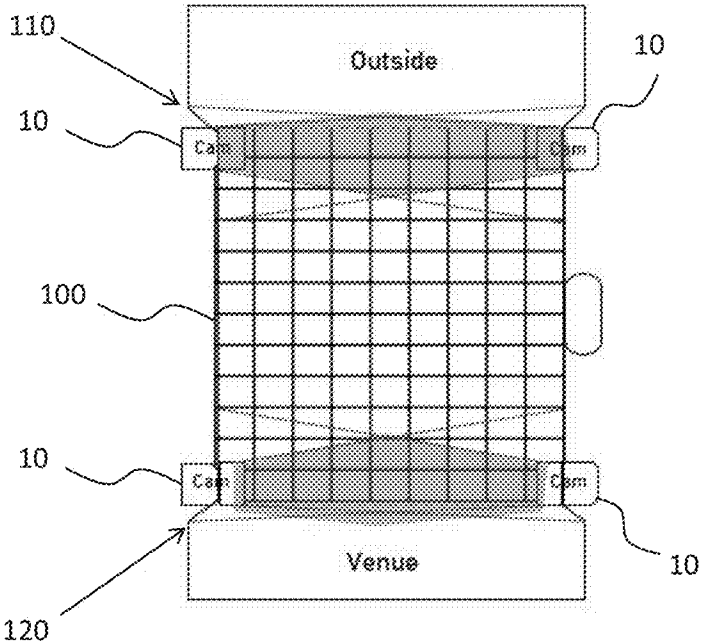
FIG. 4A is an orthogonal view of a funnel grid associated with a given predefined space within which the credential verification system of FIG. 1 is implemented, in accordance with an embodiment of the present invention.

In addition to the plurality of transmitters 20, as shown in FIGS. 4A-4B, the credential verification system includes a plurality of cameras 10 disposed within the predetermined grid described in detail above. Similar to the plurality of transmitters 20, the cameras 10 include an associated field of vision within which audio and/or visual data can be detected, captured, and recorded; the captured data is transmitted to the position engine, as described above. The function of the cameras 10 is to provide visual data related to persons located within the predetermined grid 100, and transmit the data to the computing device 30 for display via the position engine.

As shown in FIGS. 4A-4B, different camera 10 orientations can be used depending on the predetermined grid 100. For example, as shown in FIG. 4A, an embodiment of the system includes a funnel grid system in which the predetermined grid 100 is defined by a threshold 110 on one end and an entry point 120 to a venue on an opposing end, with a space disposed between the threshold and the entry point. As such, cameras 10 can be disposed at each of the threshold 110 and the entry point 120 to provide visual feedback related to persons traversing the threshold 110 into the space, and persons traversing past the entry point 120 and into a venue. Similarly, as shown in FIG. 4B, an embodiment of the system includes a plurality of cameras 10 disposed around a perimeter of the predetermined grid 100 capturing a field of vision, in combination, throughout substantially the entirety of the predetermined grid 100. As such, one or more of the plurality of cameras 10 captures visual data related to persons moving from the threshold 110 to the venue entrance 120.

Figure 5:
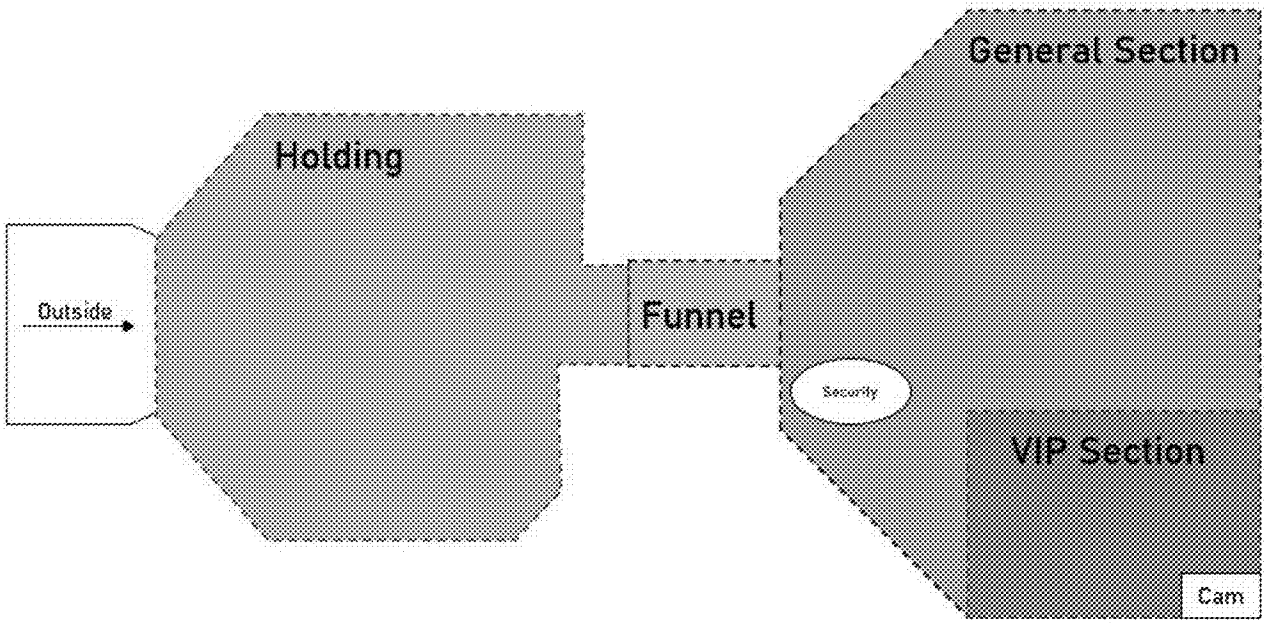
FIG. 5 is an orthogonal view of a combined credential verification system of FIG. 1, including a holding space, a funnel space, and a discrete section within a venue, in accordance with an embodiment of the present invention.
Figure 6:
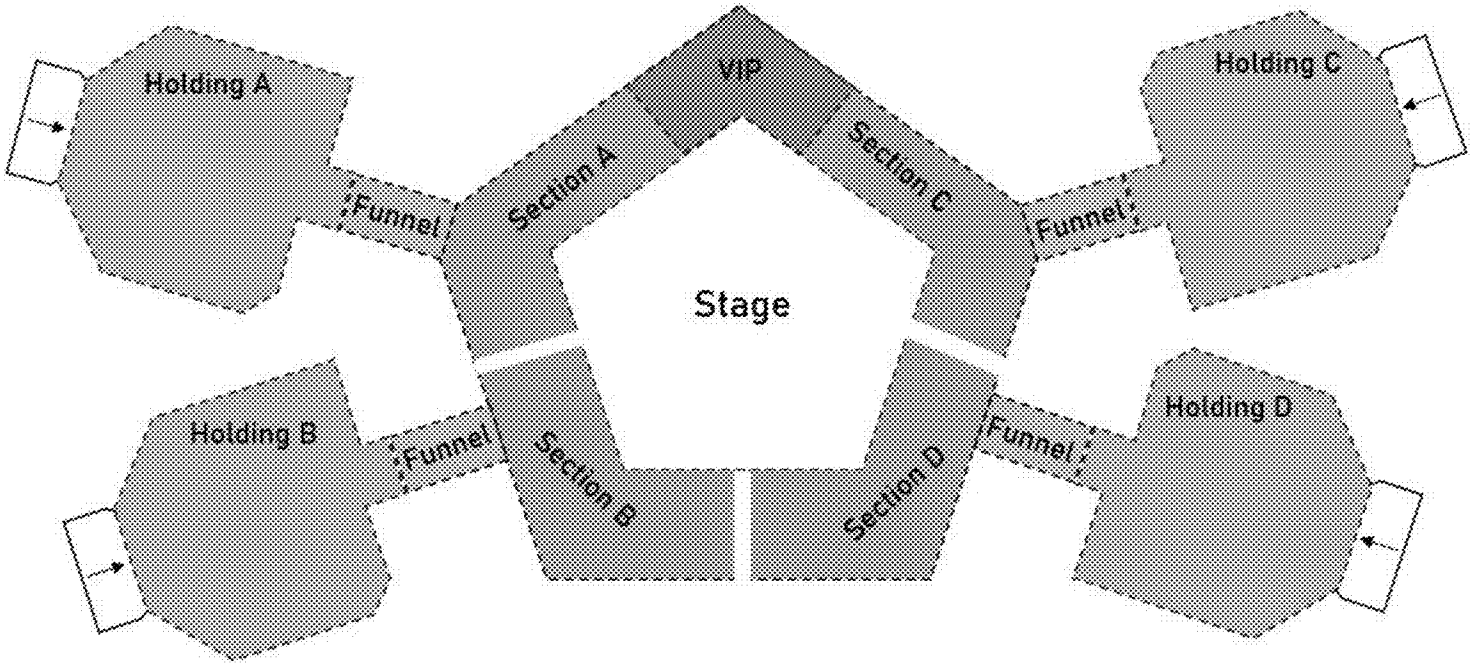
FIG. 6 is an orthogonal view of a combined credential verification system of FIG. 1, including a plurality of holding spaces, funnel spaces, and discrete sections within a venue, in accordance with an embodiment of the present invention.

Different combinations of cameras 10 and/or transmitters 20 are contemplated for use within the credential verification system depending on the requirements of an end-user venue. For example, as shown in FIGS. 5-6, a given venue may include a holding area and a funnel disposed outside of the venue to allow entrance for credentialled patrons to enter the venue. In addition, the venue itself may include different sections therein that require a further credential for entrance, such as a VIP section including a higher ticketed value. As such, different sections of the overall credential verification system include an arrangement of cameras 10 and transmitters 20 as required by the individual area, as discussed in the sections above, to track and verify a presence of an authorized individual within the given area.

Figure 7A:
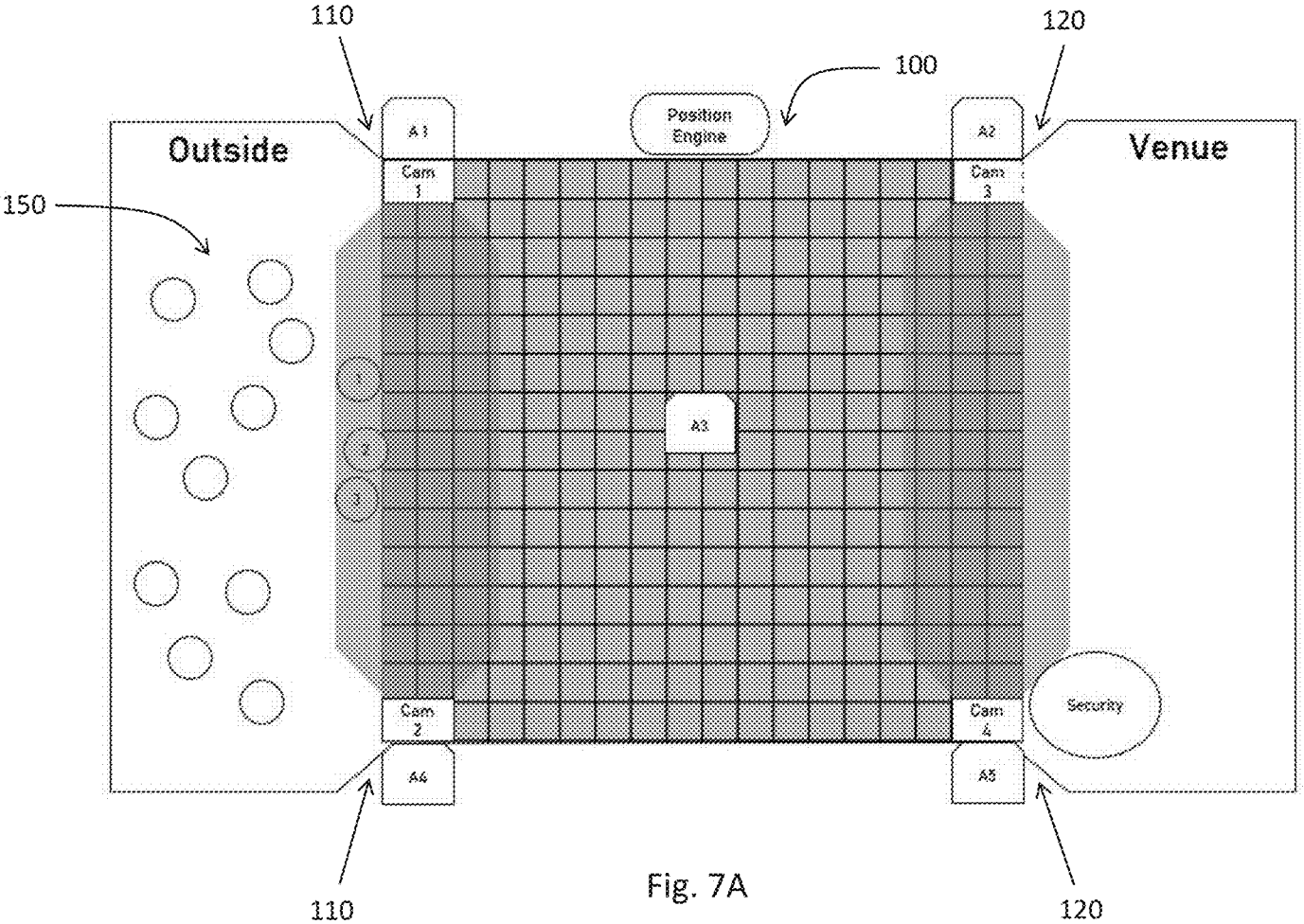
FIG. 7A is an orthogonal view of a funnel grid system including an initial threshold spaced apart from an entry point for a venue, in accordance with an embodiment of the present invention.
Figure 7B:
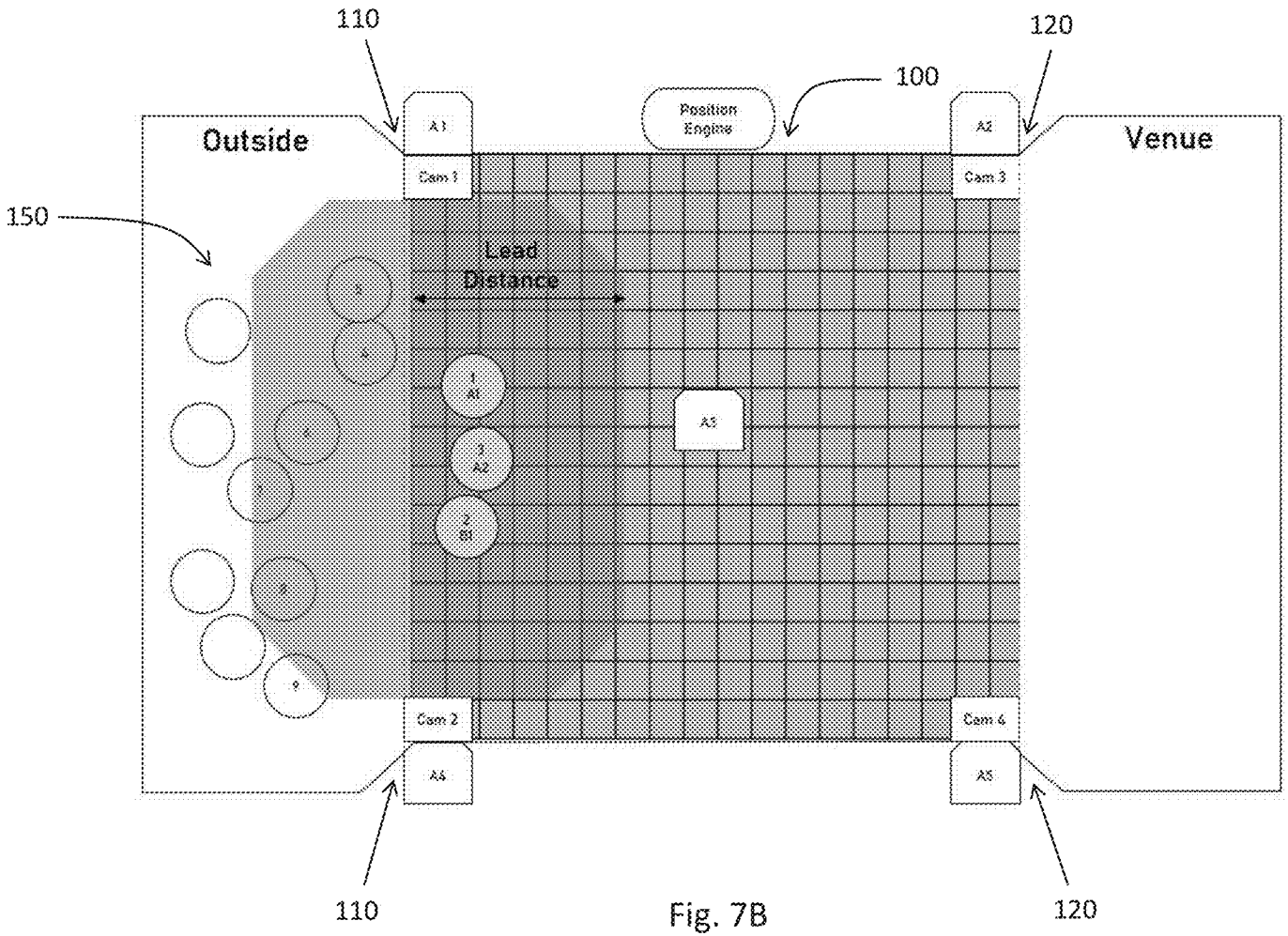
FIG. 7B is an orthogonal view of the funnel grid system of FIG. 5A, depicting a movement of patrons across the initial threshold in a direction toward the entry point for the venue in accordance with an embodiment of the present invention.
Figure 7C:
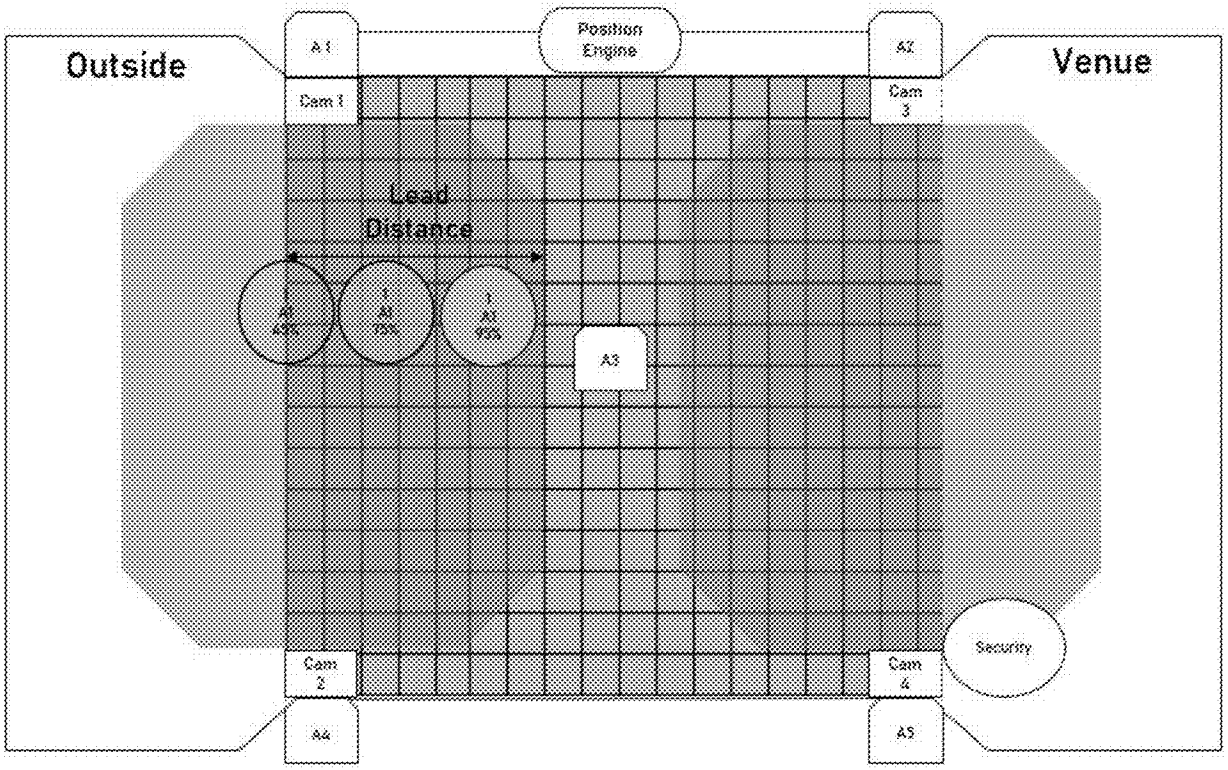
FIG. 7C is an orthogonal view of the funnel grid system of FIG. 5A, depicting a confidence level associated with a valid entry of each patron based on a lead distance between the patron and the threshold, as each patron moves toward the entry point of the venue, in accordance with an embodiment of the present invention.

As noted in the sections above, the credential verification system is designed to capture data related to a presence of one or more individuals within a predetermined grid 100 to determine whether the individual should gain access to a venue, airplane, restaurant, or other ticketed or limited capacity space. Turning now to FIGS. 7A-7C, an embodiment of the system accomplishes the verifying by using a combination of data captured by each of the camera component 10 and the transmitter component 20, which is transmitted to and received by the position engine, for entry verification. The predetermined grid 100 is defined on one end by a threshold 110—a position in space between an outside portion of the venue and the entrance 120 of the venue—and on an opposing end by the entrance 120 of the venue. Between the threshold 110 and the entrance 120 is a space through which individuals can move from the threshold 110 in a direction toward the entrance 120 to gain entrance into the venue. The system is designed such that one or more cameras (Cam 1 and Cam 2) is disposed at the threshold, and one or more cameras (Cam 3 and Cam 4) is disposed at the entrance; similarly, the predetermined grid 100, as discussed above, is defined by the transmitters (A1, A2, A3, A4, and A5) and their associated coverage space, such that each discrete portion of the predetermined grid 100 receives coverage from at least one transmitter, and optimally more than one transmitter.

As shown in FIG. 7A in particular, a plurality of patrons 150 are disposed outside of the predetermined grid 100 prior to crossing the threshold 110 into the space between the threshold 110 and the entrance 120 to the venue. As the patrons 150 approach the threshold, they enter into the field of vision of the one or more cameras 10 disposed at the threshold of the predetermined grid 100, example, as shown in FIG. 7A, three of the patrons (labelled as 1, 2, and 3 in FIG. 7A) are located within the field of vision of the threshold cameras (Cam 1 and Cam 2). The visual data captured by the cameras is transmitted to the position engine, with each of the three patrons (1, 2, and 3) being counted by the position engine for real-time tracking.

Turning to FIG. 7B, additional patrons 150 (labelled as 4, 5, 6, 7, 8, and 9 in FIG. 7B) enter the field of vision of the threshold cameras prior to crossing the threshold 110. In addition, the three patrons previously counted (labelled as 1-A1, 1-A2, and 1-A3 in FIG. 7B) move in a direction toward the entrance 120 to the venue. As the three patrons 1-A1, 1-A2, and 1-A3 cross the threshold 110 into the predetermined grid 100, one or more of the transmitters (A1, A2, A3, A4, and A5) begin querying for a presence of a valid credential, such as a barcode, quick-response code, or other associated unique data point, to verify the credential against a database of credentials, located on the position engine. Based on a match between the queried credential and the database credential, a patron is allowed admission into the venue. A lead distance measured from the threshold 110 toward the entrance 120 provides for multiple queries of the credential to take place, such that the system does not rely on an instantaneous result at the point of entrance.

In an embodiment, upon querying for a credential, the one or more transmitters 20 receive the queried information at least partially in the form of positional data related to a pinged location of a mobile device 40 of a patron 150. The pinged location includes at least an elevation angle of the mobile device 40 with respect to a vertical plane, as well as an azimuth angle of the mobile device 40 with respect to a horizontal plane. The elevation angle and the azimuth angle data are transmitted to the position engine for plotting on an overlayed grid, such that the position engine performs both triangulation and trilateration to determine a location of the pinged mobile device 40 on the predetermined grid. Moreover, as the transmitters 20 ping location data from a plurality of mobile devices 40 within the predetermined grid 100, the position engine plots the locations of each of the mobile devices 40 to develop a relative location of each mobile device 40 within the predetermined grid 100.

As shown in FIG. 7C, as a patron (labelled as 1-A1 in FIG. 7C) traverses through the lead distance and is located closer to the entrance 120 and further from the threshold 110, the position engine increases a confidence level of a verified credential associated with a given patron 1-A1. For example, as shown in FIG. 7C, a patron located at the threshold may have an associated confidence level of 45%; however, as the patron travels toward the entrance, the confidence level increases to 75% at a second location, and to 95% at a third location. The confidence level is derived from the number of queries made by the transmitters to an electronic device associated with the patron if only one query is made, the confidence level may be relatively low, such as the situation with a patron located at the threshold. As more queries for a credential match are made and data is received from the electronic device, the confidence level increases as the position engine receives a verified credential from the patron. In an embodiment of the system, a confidence level above a certain threshold (i.e., a minimum acceptable value) for an individual patron or a group of associated patrons results in entrance to the venue; a confidence level below the certain threshold results in an alert transmitted to security personnel to investigate the patron or the group of associated patrons.

As noted above, the system relies not only on transmitter 20 data related to the querying of credentials from the patrons, but also on the raw number of individuals within a given area as measured by the cameras 10. As such, the cameras 10 and the transmitters 20 provide a detailed picture of the identities and validity of credentials for patrons within a given area, such that patrons without proper credentials can be quickly and easily isolated from credentialled individuals by using camera 10 data in combination with transmitter 20 data—for example, if the cameras 10 detect a presence of ten individual patrons, and the transmitters 20 detect a presence of only eight proper credentials, the position engine can not only identify a location of the eight proper credentials, but also can transmit an alert to security personnel of the location of the two improper credentials.

Moreover, in embodiments of the system, a single patron is associated with a mobile device 40 having multiple valid credentials, such as a situation in which a family including parents and children attend an event at a given venue. Moreover, a different patron lacks a valid credential and is instead attempting to gain access to the venue without a credential. In such a situation, an agreement between an amount of valid credentials and a total number of patrons within a given area may not equate to total compliance with valid credentialing, such as if the patron having multiple credentials possesses an extra credential. As the one or more transmitters 20 receive queried information from patrons located within the predetermined grid, the position engine calculates a confidence level for each patron within the predetermined grid. As groups of patrons travel together across the threshold 110 and toward the entrance 120, the position engine increases the confidence level for nonresponsive patrons within the group based on an association with the ticket holder. Accordingly, an uncredentialed patron separated from a group of patrons receives a low confidence level even during a situation in which a total amount of credentials matches a total amount of patrons within the predetermined grid.

Figure 8B:
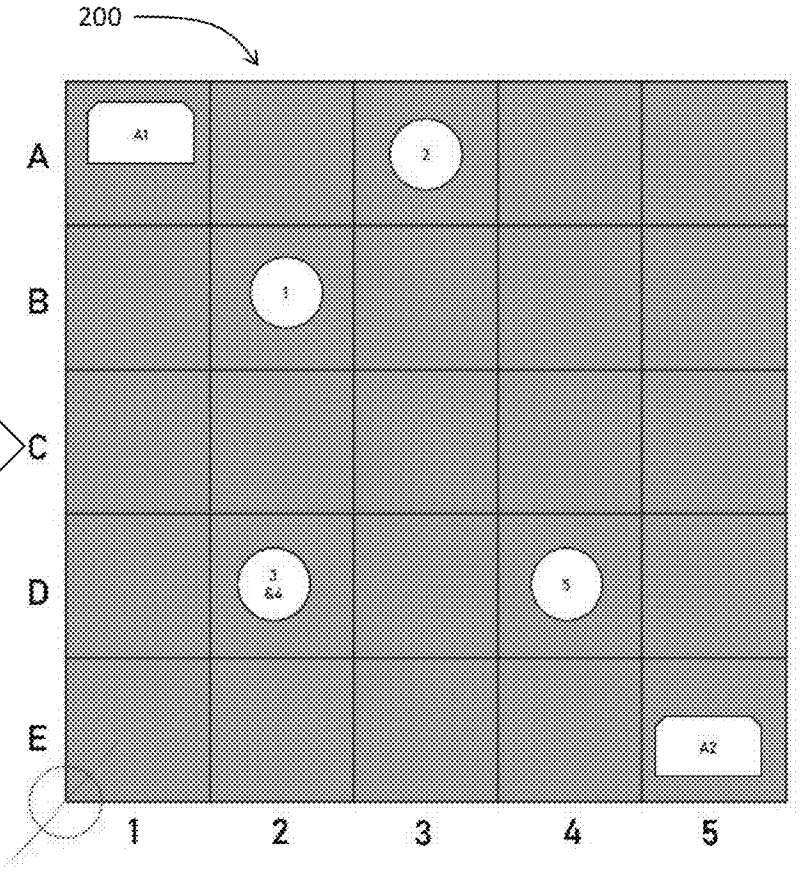
FIG. 8B is an orthogonal view of a customizable and scalable grid system overlayed on the graphical user interface of FIG. 8A, depicting a relative location of each individual patron within the given space, in accordance with an embodiment of the present invention.
Figure 8A:
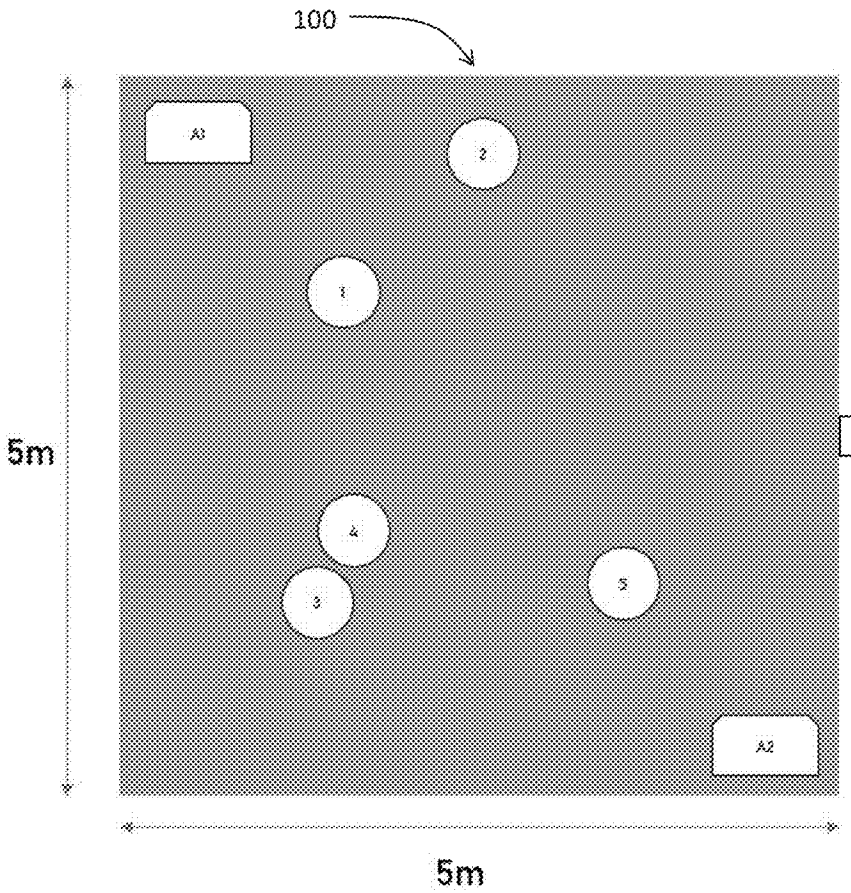
FIG. 8A is an orthogonal view of a graphical user interface associated with the position engine of FIG. 1, showing a plurality of individual patrons within a given space, in accordance with an embodiment of the present invention.

An embodiment of the system quantifies the individuals with and without credentials based on a position-based grid 200 within the predetermined grid 100, as shown in FIGS. 8A-8B. Specifically, as shown in FIGS. 8A-8B, an embodiment of the system includes a predetermined space having a given size, such as 5 m by 5 m, that receives a virtual overlay of a grid by the position engine (as shown in FIG. 8B in particular, including individual segments of equal size; in the case of FIG. 8B, 1 m by 1 m segments). A plurality of individuals (labelled as 1, 2, 3, 4, and 5 in FIGS. 8A-8B) are present within the predetermined grid 100, which, similar to the grid discussed in detail above, includes a plurality of cameras 10 and a plurality of transmitters 20 disposed therein. The cameras 10 and transmitters 20 function to determine a location of each individual within the grid 100, as discussed above. The position engine receives the data from the cameras 10 and the transmitters 20, and plots the data on the position-based grid 200, which is a segmented representation of the predetermined grid 100, including segments having approximately equal dimensions. As such, the system locates and plots the individuals within the grid 200 to easily identify a presence of a valid credential within one of the grid segments, thereby determining whether the plurality of individuals include proper permission to enter a venue.

Moreover, as noted above, in certain situations individual patrons may be grouped together, with one of the patrons holding multiple credentials and the remainder of the group lacking a credential associated with their mobile device (or lacking a mobile device altogether). In addition, one or more individual patrons may lack a credential, and in the absence of a confidence level-based entrance determination, could improperly gain access to a venue. For example, referring to FIG. 8B, individuals 3 and 4 are disposed within a segment of the predetermined grid, with individuals 1, 2, and 5 each being disposed within separate segments of the predetermined grid. As each patron travels toward the entrance, the position engine calculates a confidence level for each patron. If individual 3 holds the credential for both individual 3 and individual 4, while individual 5 lacks a credential, the position engine continuously adjusts the confidence level for each patron as the system groups together patrons in close proximity to each other. Accordingly, the position engine transmits an alert, to a security personnel to investigate individual 5, and allows individual 3 and 4 to gain access to the venue.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

What is claimed is:

1. A method of verifying a valid credential associated with each of a plurality of venue patrons, the method comprising the steps of:

disposing a plurality of transmitters within an enclosed space at an event venue, the enclosed space including an initial threshold spaced apart from an entrance, such that the plurality of transmitters are disposed between the initial threshold and the entrance;

disposing a first plurality of cameras proximate to the initial threshold, such that the first plurality of cameras form a field of vision that includes the initial threshold;

disposing a second plurality of cameras proximate to the entrance, such that the second plurality of cameras form a field of vision that includes the entrance;

capturing, from the first plurality of cameras and the second plurality of cameras, an image of the enclosed space;

receiving, at the plurality of transmitters, at least one unique credential for attendance within the event venue;

receiving, on a position engine executable on a computing device, the image of the enclosed space from the first plurality of cameras and the second plurality of cameras, and displaying, on the position engine, the image of the enclosed space;

defining a virtual grid displayed on the position engine, the virtual grid defined by the initial threshold and the entrance;

counting, via the position engine, a total number of the plurality of venue patrons displayed in the image of the enclosed space;

separating, via the position engine, the plurality of venue patrons into segments of the virtual grid displayed on the position engine;

receiving, on the position engine executable on the computing device, the at least one unique credential for attendance within the event venue;

separating, via the position engine, the at least one unique credential for attendance within the event venue into segments of the virtual grid; and calculating, for each of the plurality of venue patrons, via the position engine, a confidence rating representing a validity of the at least one unique credential for attendance within the event venue based on receiving multiple copies of the at least one unique credential for attendance within the event venue, wherein, based on the confidence rating being above a minimum acceptable value for one of the plurality of venue patrons, the one of the plurality of venue patrons traverse past the entrance, and wherein, based on the confidence rating being below the minimum acceptable value for one of the plurality of venue patrons, the position engine transmits a security alert to a mobile device associated with a security personnel disposed within the enclosed space.

2. The method of claim 1, further comprising the step of defining the virtual grid by a coverage area associated with at least two of the plurality of transmitters, such that each portion of the virtual grid is associated with a discrete point of the enclosed space that receives emitted signals from at least two of the plurality of transmitters.

3. The method of claim 1, wherein the at least one unique credential for attendance within the event venue is a unique combination of characters selected from the group consisting of numbers, letters, and symbols.

4. The method of claim 3, further comprising the steps of storing, on a database of the computing device, a plurality of unique credentials for attendance within the event venue, and comparing, via the position engine, the received at least one unique credential for attendance within the event venue with the database including the plurality of unique credentials for attendance within the event venue.

5. The method of claim 1, wherein the step of counting the total number of the plurality of venue patrons further comprises the step of placing, via the position engine, a bounding box over each of the plurality of venue patrons.

6. The method of claim 1, wherein the step of receiving, at the plurality of transmitters, the at least one unique credential for attendance within the event venue further comprises the step of emitting, via the plurality of transmitters, a plurality of signals receivable by one or more mobile devices disposed within the enclosed space, each of the one or more mobile devices associated with one of the plurality of venue patrons.

7. The method of claim 6, further comprising the step of transmitting, via the one or more mobile devices, the at least one unique credential for attendance within the event venue receivable by the plurality of transmitters.

8. The method of claim 6, wherein the one or more mobile devices are selected from the group consisting of a smartphone, a tablet, and a laptop.

9. The method of claim 1, further comprising the step of verifying, via the position engine, an agreement between the total number of the plurality of venue patrons and a total number of the at least one unique credential for attendance within the event venue, wherein, based on the agreement between the total number of the plurality of venue patrons and the total number of the at least one unique credential for attendance within the event venue, each of the plurality of venue patrons traverse past the entrance, and wherein, based on a disagreement between the total number of the plurality of venue patrons and the total number of the at least one unique credential for attendance within the event venue, the position engine transmits the security alert to the mobile device associated with the security personnel disposed within the enclosed space.

10. The method of claim 1, wherein the step of defining the virtual grid displayed on the position engine further comprises segmenting the virtual grid into a plurality of predefined segments having equal area.

* * * * *